US007656246B2

(12) United States Patent
Mahon et al.

(10) Patent No.: US 7,656,246 B2
(45) Date of Patent: Feb. 2, 2010

(54) CIRCULAR POLARIZER USING CONDUCTIVE AND DIELECTRIC FINS IN A COAXIAL WAVEGUIDE

(75) Inventors: John P. Mahon, Thousand Oaks, CA (US); Cynthia P. Espino, Carlsbad, CA (US)

(73) Assignee: Optim Microwave, Inc., Westlake Village, CA (US)

( * ) Notice: Subject to any disclaimer, the term of this patent is extended or adjusted under 35 U.S.C. 154(b) by 105 days.

(21) Appl. No.: 12/058,560

(22) Filed: Mar. 28, 2008

(65) Prior Publication Data

US 2009/0243761 A1 Oct. 1, 2009

(51) Int. Cl.
*H01P 1/17* (2006.01)

(52) U.S. Cl. ..... 333/21 A; 333/157; 333/160

(58) Field of Classification Search ..... 333/21 A, 333/126, 134, 135, 136, 137, 157, 160
See application file for complete search history.

(56) References Cited

U.S. PATENT DOCUMENTS 4,523,160 A * 6/1985 Ploussios ..... 333/21 A
4,725,795 A * 2/1988 Ajioka et al. ..... 333/126
4,982,171 A * 1/1991 Figlia et al. ..... 333/157
6,417,742 B1 7/2002 Enokuma

* cited by examiner

*Primary Examiner*—Benny Lee
(74) *Attorney, Agent, or Firm*—SoCal IP Law Group LLP; Mark A. Goldstein; John E. Gunther

(57) ABSTRACT

There is disclosed a linear polarization to circular polarization converter. An outside surface of an inner conductor may be coaxial with the inside surface of an outer conductor. First and second diametrically opposed conductive fins may extend outward from the outer surface of the inner conductor. First and second dielectric fins may be interlocked with the first and second conductive fins, respectively.

18 Claims, 6 Drawing Sheets

Section A-A

Section B-B
136
100
45°
120
122
140
142
144
d1
d4
d3
d2
120
132a
134

Section C-C
100
120
122
140
120
132b
134

Section B'-B'

Section C'-C'

CIRCULAR POLARIZER USING CONDUCTIVE AND DIELECTRIC FINS IN A COAXIAL WAVEGUIDE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to linear polarization to circular polarization converters for use in coaxial waveguides.

2. Description of the Related Art

Satellite broadcasting and communications systems commonly use separate frequency bands for the uplink to and downlink to and from satellites. Additionally, one or both of the uplink and downlink typically transmit orthogonal right-hand and left-hand circularly polarized signals within the respective frequency band.

Typical antennas for transmitting and receiving signals from satellites consist of a parabolic dish reflector and a coaxial feed where the high frequency band signals travel through a central circular waveguide and the low frequency band signals travel through an annular waveguide coaxial with the high-band waveguide. An ortho-mode transducer (OMT) may be used to launch or extract orthogonal $TE_{11}$ linear polarized modes into the high- and low-band coaxial waveguides. TE (transverse electric) modes have an electric field orthogonal to the longitudinal axis of the waveguide. Two orthogonal $TE_{11}$ modes do not interact or cross-couple, and can therefore be used to communicate different information. A linear polarization to circular polarization converter is commonly disposed within each of the high- and low-band coaxial waveguides to convert the orthogonal $TE_{11}$ modes into left- and right-hand circular polarized modes for communication with the satellite.

Converting linearly polarized $TE_{11}$ modes into circularly polarized modes requires splitting each $TE_{11}$ mode into two orthogonally polarized portions and then shifting the phase of one portion by 90 degrees with respect to the other portion. This may conventionally be done by inserting two or more dielectric vanes, oriented at 45 degrees to the polarization planes of the $TE_{11}$ modes, into the waveguide as described in U.S. Pat. No. 6,417,742 B1. However, assembling the dielectric vanes at the precise angle within the waveguide can be problematic. Errors in assembling the dielectric vanes can result in imperfect polarization conversion and cross-talk between the two orthogonally polarized $TE_{11}$ modes.

Throughout this description, elements appearing in figures are assigned three-digit reference designators, where the most significant digit is the figure number where the element was first introduced and the two least significant digits are specific to the element. An element that is not described in conjunction with a figure may be presumed to have the same characteristics and function as a previously-described element having the same reference designator.

DETAILED DESCRIPTION

Description of Apparatus

Figure 1A:
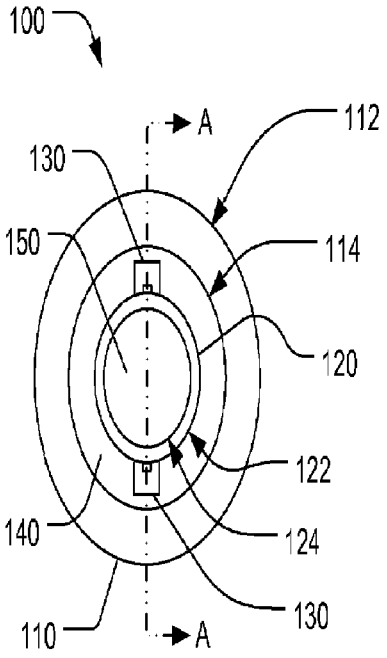
FIG. 1A is an end view of a coaxial waveguide including a linear polarization to circular polarization converter.
Figure 1B:
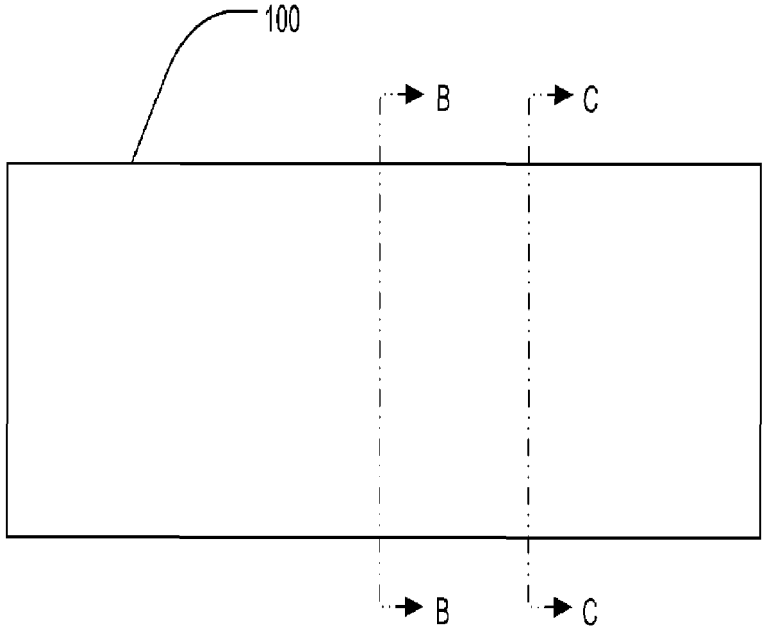
FIG. 1B is a side view of a coaxial waveguide including a linear polarization to circular polarization converter.

FIG. 1A is an end view of a linear polarization to circular polarization converter 100, and FIG. 1B is a side view of the linear polarization to circular polarization converter 100. As shown in FIG. 1A, the linear polarization to circular polarization convener 100 may include an outer conductor 110 and an inner conductor 120. The inner conductor 120 may have an outer surface 122 that has a generally circular cross section except for two diametrically opposed fins 130 extending outward from the outer surface 122. The outer conductor 110 may have an inner surface 114 that is generally coaxial with the outer surface 122 of the inner conductor 120. In this description, the terms generally circular and generally coaxial mean circular and coaxial within the limits of reasonable manufacturing tolerances. The space between the inner surface 114 of the outer conductor 110 and the outer surface 122 of the inner conductor 120 may define an annular waveguide 140.

The inner conductor 120 may be generally in the form of a tube having an inner surface 124 with a generally circular cross section. The inner surface 124 may define a circular waveguide 150.

The outer conductor 110 may have an outer surface 112 that may be generally circular in cross section, as shown in FIG. 1A, or may be another shape. For example, the outer surface 112 may have a square cross section for ease of manufacturing and/or mounting.

Figure 2:
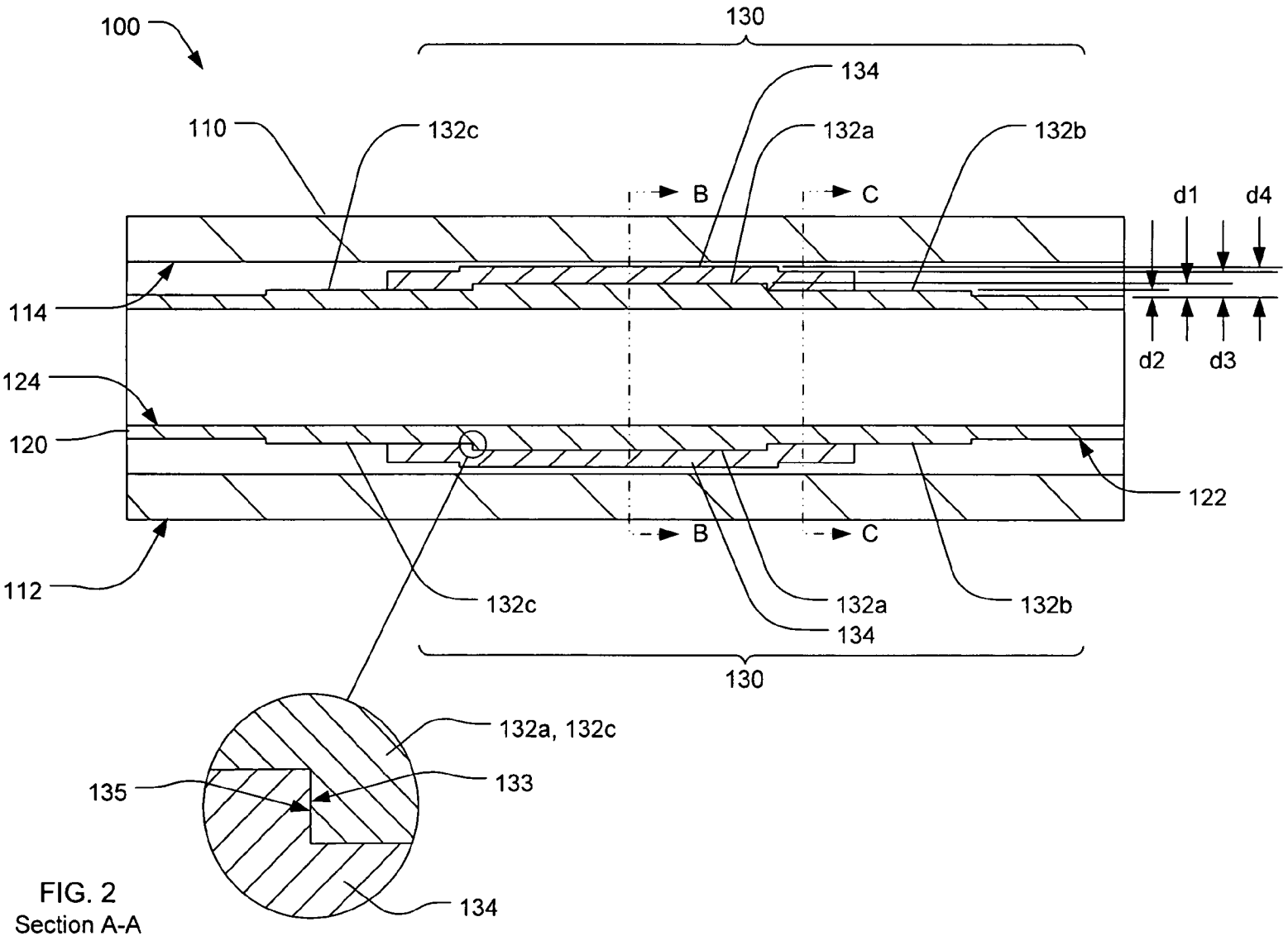
FIG. 2 is a longitudinal cross section of the coaxial waveguide of FIG. 1A.

FIG. 2 shows a cross section of the linear polarization to circular polarization converter 100 along a plane A-A as identified in FIG. 1A. The linear polarization to circular polarization converter 100 may include an outer conductor 110 having an outer surface 112 and an inner surface 114. The linear polarization to circular polarization converter 100 may also include an inner conductor 120 having an outer surface 122 and an inner surface 124. Two diametrically opposed fins 130 may extend from the outer surface 122 of the inner conductor 120.

The diametrically opposed fins 130 may include a conductive fin 132*a*/132*b*/132*c* and a dielectric fin 134. Each conductive fin 132*a*/132*b*/134*c* may be stepped in a longitudinal direction. Each conductive fin may include a central portion 132*a* flanked by symmetrical side portions 132*b* and 132*c*. The central portion 132*a* may extend a first distance d1 from the outer surface 122. The outer portions 132*b* and 132*c* may extend a second distance d2 from the outer surface 122, where the second distance d2 is less than the first distance d1. Each dielectric fin 134 may extend at least a third distance d3 from the outer surface 122, where d3 is greater than d1. The distance that each dielectric fin 134 extends from the outer surface 122 may be stepped. Each dielectric fin may include a central portion that extends a fourth distance d4 from the outer surface 122, where d4 is greater than d3.

As shown in the detail at the lower left of FIG. 2, the conductive fin may include a step 133 between the side portion 132*c* and the central portion 132*a*. A similar step may exist between the central portion 132*a* and the side portion 132*b*. The dielectric fin may include a complementary step 135. The interface between the step 135 in the dielectric fin 134 and the step 133 in the conductive fin may act to position and constrain the dielectric fin 134 in the longitudinal direction.

Figures 3A, 3B:
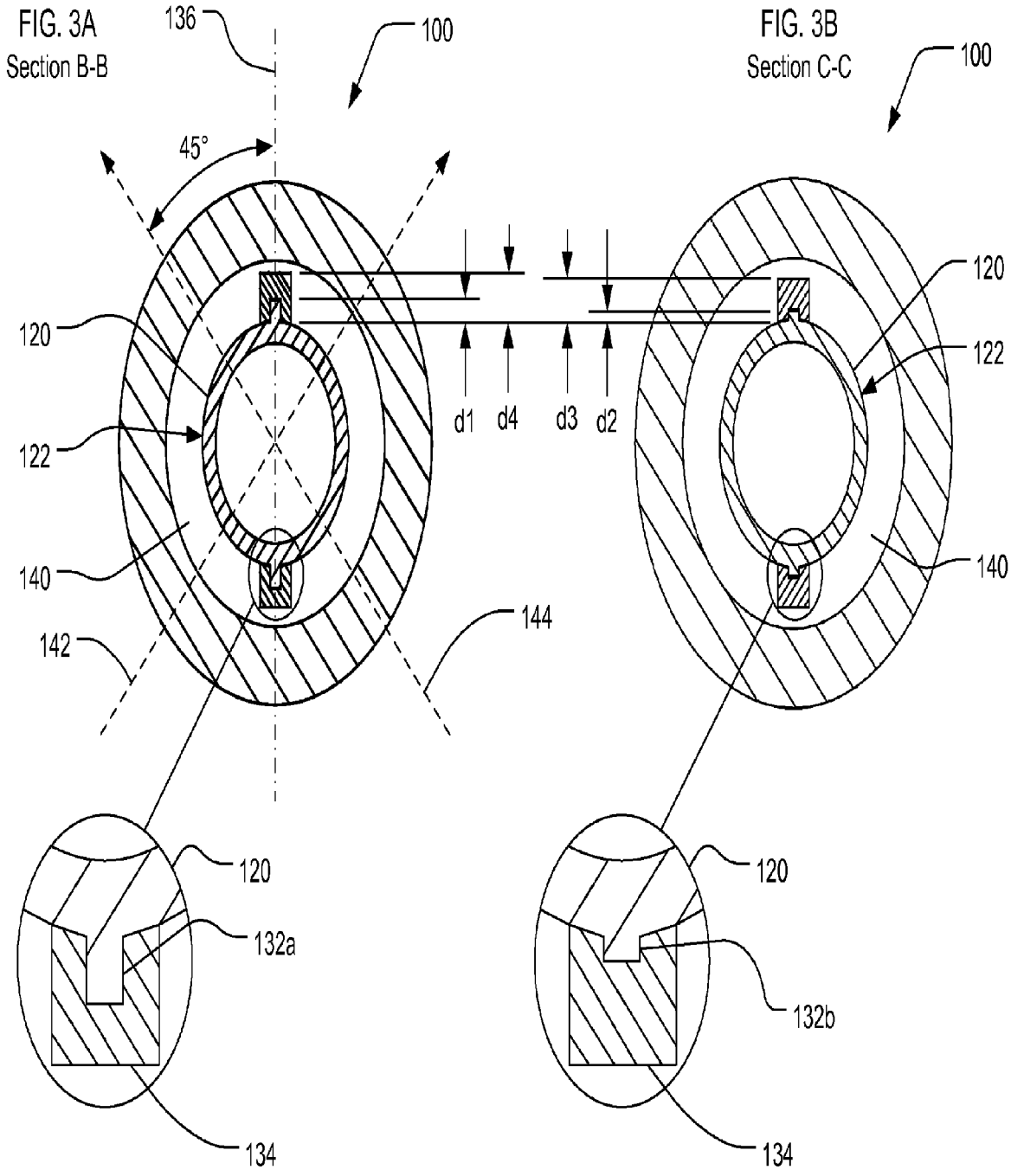
FIG. 3A is a first axial cross section of the coaxial waveguide of FIG. 1B.
FIG. 3B is a second axial cross section of the coaxial waveguide of FIG. 1B.

FIG. 3A and FIG. 3B show cross sections of the linear polarization to circular polarization converter 100 along plane B-B and plane C-C, respectively, as identified in FIG. 1B and FIG. 2. Each dielectric fin 134 may be formed with a longitudinal (perpendicular to the plane of the drawings) notch that may engage the respective conductive fin portions 132*a* and 132*b* as shown in FIGS. 3A and 3B, respectively. The notch in each dielectric fin 134 may be conformal or nearly conformal to the conductive fin portions 132*a* and 132*b* such that the conductive fin portions 132*a* and 132*b* align and constrain the respective dielectric fin 134 in the transverse direction.

The conductive fin portions 132*a*, 132*b*, 132*c* (FIG. 2) may align and constrain the position of the respective dielectric fin 134 both longitudinally and transversely such that each dielectric fin 134 is interlocked with the corresponding conductive fin 132*a*, 132*b*, 132*c*. In this description, "interlocked" has the normal meaning of "connected in such a way that the motion of any part is constrained by another part". Within the linear polarization to circular polarization converter 100, the position of each dielectric fin 134 may be aligned and constrained by the corresponding conductive fin 132*a*, 132*b*,132*c*.

The inner conductor 120 may be fabricated from aluminum or copper or another highly conductive metal or metal alloy. The conductive fins 132*a*, 132*b*, 132*c* may be integral to the inner conductor. The conductive fins 132*a*, 132*b*, 132*c* may be fabricated by numerically controlled machining and thus may be precisely located on the outer surface 122 of the inner conductor 120. The dielectric fins 134 may be fabricated from a low-loss polystyrene plastic material such as Rexolite (available from C-LEC Plastics) or another dielectric material suitable for use at the frequency of operation of the linear polarization to circular polarization converter 100.

Referring to FIG. 3A, the conductive fins 132*a*, 132*b*, (FIG.3B) and the dielectric fins 134 may be symmetrical about a symmetry plane 136 passing through the axis of the inner conductor 120. In use, the symmetry plane 136 may be oriented at a 45 degree angle to the polarization planes 142 and 144 of two linearly polarized TE modes traveling in the annular waveguide 140.

Figure 4A:
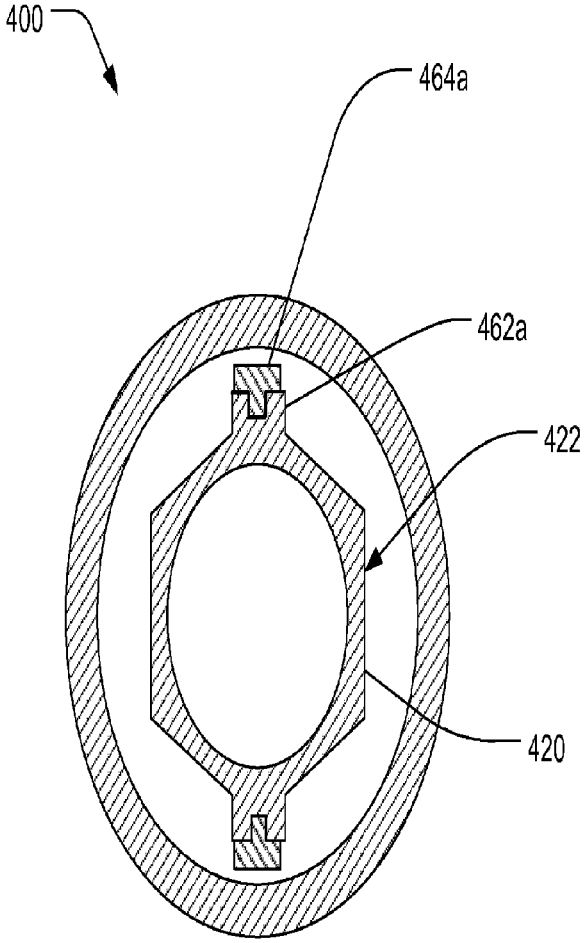
FIG. 4A is a first axial cross section of another linear polarization to circular polarization converter.
Figure 4B:
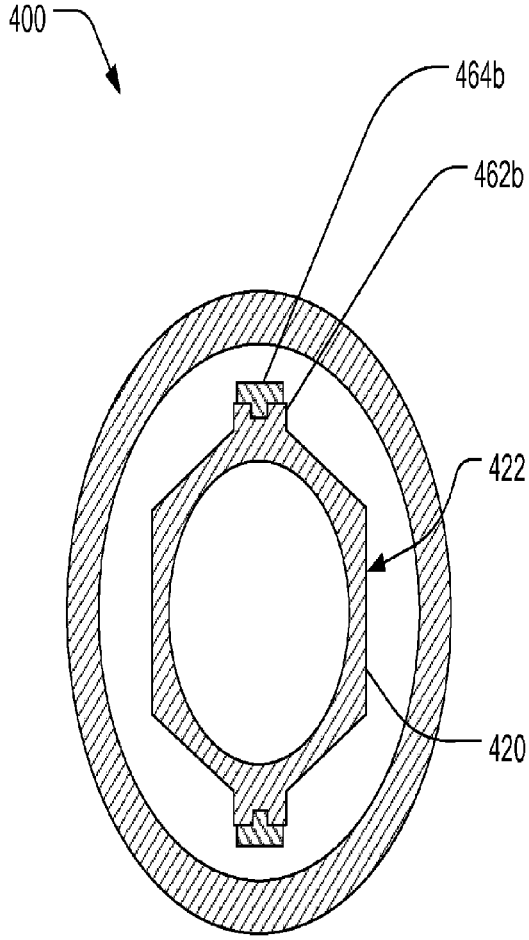
FIG. 4B is a second axial cross section of the linear polarization to circular polarization converter of FIG. 4A.

FIG. 4A and FIG. 4B show cross sections of another linear polarization to circular polarization converter 400 along plane B'-B' and plane C'-C', respectively, which may be the same as planes B-B and C-C identified in FIG. 1B and FIG. 2.

The linear polarization to circular polarization convener 400 may include an inner conductor 420 having an outer surface 422. A pair of diametrically opposed conductive fins 462*a*/462*b*, which are shown in FIG. 4A and FIG. 4B respectively, may extend outward from the outer surface 422. A pair of dielectric fins 464*a*/464*b*, which are shown in FIG. 4A and FIG. 4B respectively, may be interlocked with the respective conductive fins. The dielectric fins 464*a*/464*b* may have a "T"-shaped cross-section. The legs of the "T"-shaped dielectric fins 464*a*/464*b* may fit within mating longitudinal slots in the corresponding conductive fins 462*a*/462*b*. The conductive fins 462*a*/462*b* may align and constrain dielectric fins 464*a*/464*b* as previously described.

The linear polarization to circular polarization converter 400 may include an inner conductor 420 having an outer surface 422. The outer surface 422 may have a cross-sectional shape of a hexagon, as shown, an octagon, or another regular polygon with an even number of sides. An outer surface having a circular cross section, such as the surface 112 in FIG. 1, may be fabricated by turning on a lathe. However, the presence of conductive fins 132*a*/132*b*/132*c* or 462*a*/462*b* precludes the use of a lathe, and the outer surface of the inner conductor 122 or 422 may be fabricated by numerically controlled milling. The polygonal cross-section of the outer surface 422 may be less costly to machine than the circular cross-section of the outer surface 122.

The "T"-shaped dielectric fins 464*a*/464*b* and corresponding conductive fins 462*a*/462*b* of FIG. 4A and FIG. 4B respectively, and the dielectric fins 134 (e.g. FIG. 2) and corresponding conductive fins 132*a*/132*b* of FIG. 3A and FIG. 3B respectively, are examples of dielectric fins that are mechanically interlocked with conductive fins. The dielectric fins and the conductive fins may incorporate other combinations of tabs, slots, pins, holes, or any other mechanisms that allow the conductive fins to support and align the dielectric fins may be used.

Other combinations of dielectric and conductive fins may be used with an inner conductor having an outer surface with either a circular cross-section or polygonal cross-section. For example, the "T"-shaped dielectric fins 464*a*/464*b* and corresponding conductive fins 462*a*/462*b* of FIG. 4A and FIG. 4B respectively may be used with an inner conductor having an outer surface with a circular cross section. Conversely, the dielectric fins 134 and corresponding conductive fins 132*a*/132*b* of FIG. 3A and FIG. 3B respectively may be combined with an inner conductor having an outer surface with a polygonal cross-section.

A linear to circular polarization converter, such as the linear to circular polarization converters 100 and 400, may be designed by using a commercial software package such as CST Microwave Studio. An initial model of the linear to circular polarization converter may be generated with estimated dimensions for the waveguide, conductive fins and dielectric fins. The structure may then be analyzed, and the reflection coefficients and the relative phase shift for two orthogonal linearly polarized modes may be determined. The dimensions of the model may be then be iterated manually or automatically to minimize the reflection coefficients and to set the relative phase shift at or near 90 degrees across an operating frequency band.

Figure 5:
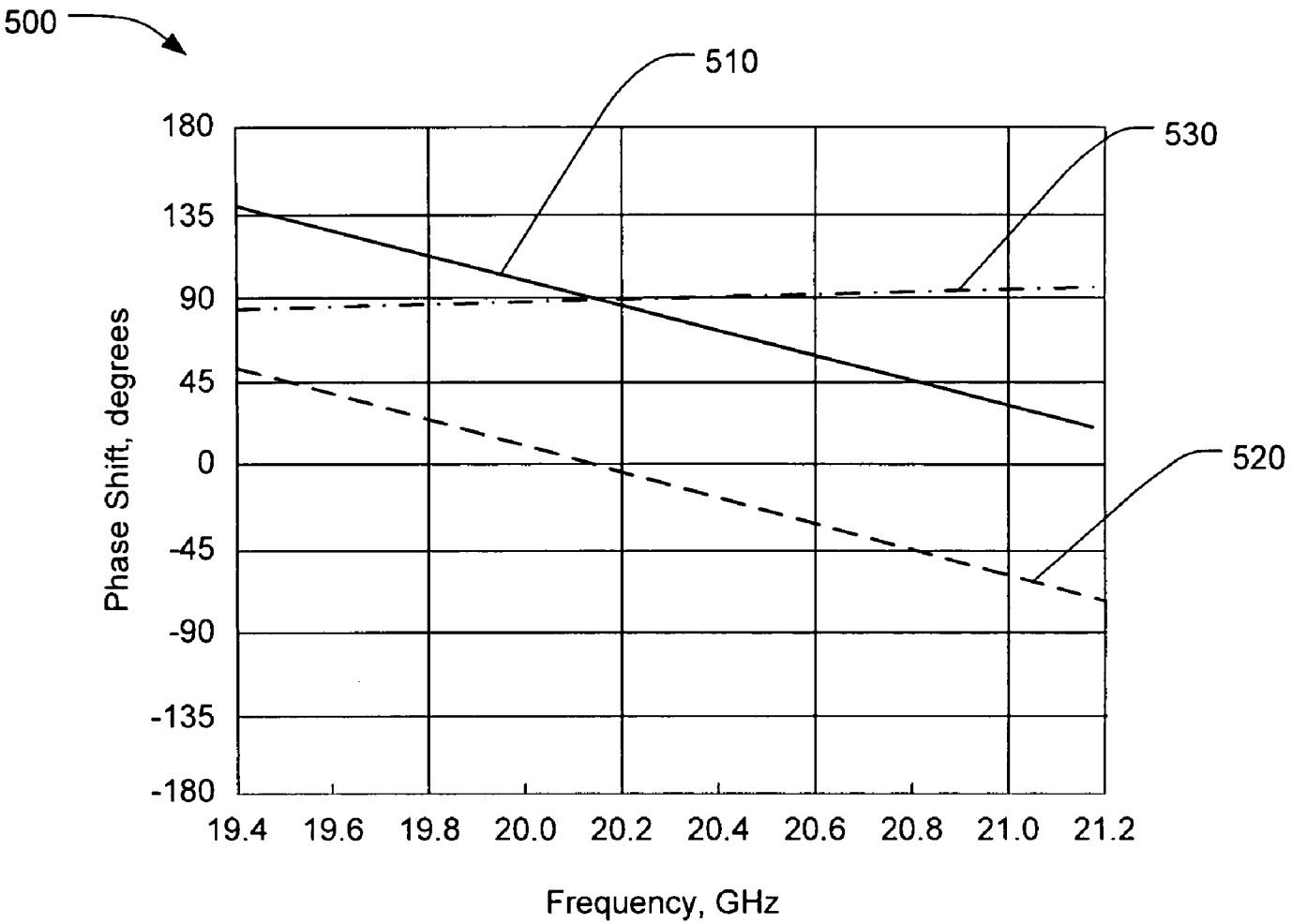
FIG. 5 is a graph showing the simulated performance of a linear polarization to circular polarization converter.

FIG. 5 is a graph 500 illustrating the simulated performance of a linear to circular polarization converter similar to the linear to circular polarization converter 100. The performance of the linear to circular polarization converter was simulated using finite integral time domain analysis. The time-domain simulation results were Fourier transformed into frequency-domain data as shown in FIG. 5. The solid line 510 and the dashed line 520 plot the phase shift introduced by the linear to circular polarization converter in two orthogonal linearly polarized $TE_{11}$ modes. The interrupted line 530 plots the relative phase shift introduced into the two modes (the difference between the plots 510 and 520). The relative phase shift varies from roughly 87 degrees to 92 degrees over a frequency band from 19.4 GHz to 21.2 GHz. The efficiency of conversion from a linearly polarized $TE_{11}$ mode to a circularly polarized mode is equal to (1+sin(phase shift angle))/2. Thus the data shown in FIG. 5 indicates that more than 99.9% of the energy in the $TE_{11}$ mode will be convened into the desire circularly polarized mode across the 19.4 GHz to 21.2 GHz frequency band.

Figure 6:
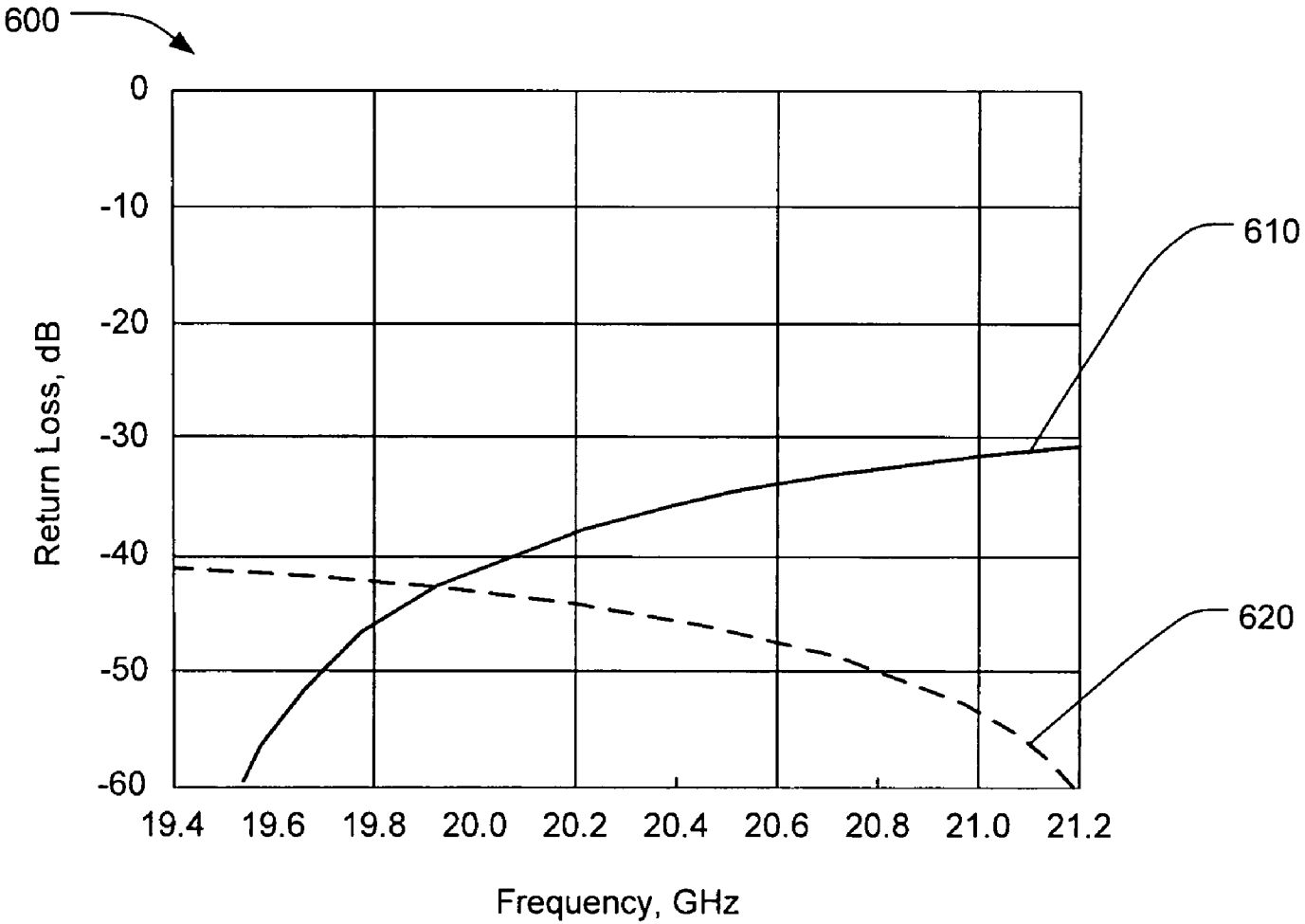
FIG. 6 is a graph showing the simulated performance of a linear polarization to circular polarization converter.

FIG. 6 is another graph 600 illustrating the simulated and measured performance of a linear to circular polarization converter similar to the linear to circular polarization converter 100. The solid line 610 and the dashed line 620 plot the return loss introduced by the linear to circular polarization convener in two orthogonal linearly polarized $TE_{11}$ modes. The return loss is less than 30 dB over a frequency band from 194 GHz to 21.2 GHz.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A linear polarization to circular polarization converter, comprising:

an inner conductor having an outside surface an outer conductor having an inside surface coaxial with the outside surface of the inner conductor first and second diametrically opposed conductive fins extending outward from the outer surface of the inner conductor first and second dielectric fins interlocked with the first and second conductive fins, respectively wherein the first and second dielectric fins each include a longitudinal notch that engages the respective conductive fin.

2. The linear polarization to circular polarization convener of claim 1, wherein the dielectric fins are formed from low loss polystyrene plastic.

3. The linear polarization to circular polarization convener of claim 1, wherein the inner conductor includes one of aluminum alloy and copper.

4. The linear polarization to circular polarization converter of claim 1, wherein the conductive fins are an integral part of the inner conductor.

5. The linear polarization to circular polarization converter of claim 1, wherein the first and second conductive fins and the first and second dielectric fins are symmetric about a symmetry plane passing though the center of the inner conductor and inclined at an angle of 45 degrees with respect to a linear plane of polarization.

6. The linear polarization to circular polarization converter of claim 5, wherein the first and second conductive fins and the first and second dielectric fins are adapted to collectively introduce a relative phase shift of 90 degrees between electromagnetic radiation polarized parallel to the symmetry plane and electromagnetic radiation polarized normal to the symmetry plane, wherein the electromagnetic radiation falls within a predetermined frequency band.

7. The linear polarization to circular polarization converter of claim 1, wherein the outside surface of the inner conductor has a generally circular cross section the inside surface of the outer conductor has a generally circular cross section coaxial with the outside surface of the inner conductor.

8. The linear polarization to circular polarization converter of claim 1, wherein the outside surface of the inner conductor has a cross section in the shape of a regular polygon the inside surface of the outer conductor has a generally circular cross section coaxial with the outside surface of the inner conductor.

9. The linear polarization to circular polarization converter of claim 8, wherein the outside surface of the inner conductor has a cross-sectional shape selected from a hexagon and an octagon.

10. A linear polarization to circular polarization converter, comprising:

an inner conductor having an outside surface an outer conductor having an inside surface coaxial with the outside surface of the inner conductor first and second diametrically opposed conductive fins extending outward from the outer surface of the inner conductor first and second dielectric fins interlocked with the first and second conductive fins, respectively wherein the outside surface of the inner conductor has a cross section in the shape of a regular polygon having an even number of sides, the number of sides equal to or greater than six, and the inside surface of the outer conductor has a generally circular cross section coaxial with the outside surface of the inner conductor.

11. The linear polarization to circular polarization converter of claim 10, wherein the outside surface of the inner conductor has a cross-sectional shape selected from a hexagon and an octagon.

12. A linear polarization to circular polarization converter comprising:

an inner conductor having an outside surface an outer conductor having an inside surface coaxial with the outside surface of the inner conductor first and second diametrically opposed conductive fins extending outward from the outer surface of the inner conductor first and second dielectric fins interlocked with the first and second conductive fins, respectively wherein the first and second conductive fins each include a longitudinal notch that engages a longitudinal leg extending from the respective dielectric fin.

13. The linear polarization to circular polarization convener of claim 12, wherein the first and second conductive fins and the first and second dielectric fins are symmetric about a symmetry plane passing though the center of the inner conductor and inclined at an angle of 45 degrees with respect to a linear plane of polarization.

14. The linear polarization to circular polarization converter of claim 13, wherein the first and second conductive fins and the first and second dielectric fins are adapted to collectively introduce a relative phase shift of 90 degrees between electromagnetic radiation polarized parallel to the symmetry plane and electromagnetic radiation polarized normal to the symmetry plane, wherein the electromagnetic radiation falls within a predetermined frequency band.

15. The linear polarization to circular polarization converter of claim 12, wherein the outside surface of the inner conductor has a generally circular cross section the inside surface of the outer conductor has a generally circular cross section coaxial with the outside surface of the inner conductor.

16. The linear polarization to circular polarization converter of claim 12, wherein the outside surface of the inner conductor has a cross section in the shape of a regular polygon the inside surface of the outer conductor has a generally circular cross section coaxial with the outside surface of the inner conductor.

17. The linear polarization to circular polarization converter of claim 16, wherein the outside surface of the inner conductor has a cross-sectional shape selected from a hexagon and an octagon.

18. The linear polarization to circular polarization converter of claim 12, wherein each of the first and second dielectric fins has a generally T-shaped cross-section.

* * * * *

UNITED STATES PATENT AND TRADEMARK OFFICE

CERTIFICATE OF CORRECTION

PATENT NO. : 7,656,246 B2
APPLICATION NO. : 12/058560
DATED : February 2, 2010
INVENTOR(S) : John P. Mahon It is certified that error appears in the above-identified patent and that said Letters Patent is hereby corrected as shown below:

Column 2, line 27: replace “convener” with --converter--.

Column 3, line 61: replace “convener” with --converter--.

Column 5, line 4: replace “convened” with --converted--.

Column 5, line 12: replace “convener” with --converter--.

Column 6, line 1: replace “convener” with --converter--.

Column 6, line 5: replace “convener” with --converter--.

Column 7, line 14: replace “convener” with --converter--.

Signed and Sealed this

Twenty-third Day of March, 2010

David J. Kappos

David J. Kappos
*Director of the United States Patent and Trademark Office*